United States Patent [19]

Denu

[11] 4,130,947

[45] Dec. 26, 1978

[54] SOLE FOR FOOTWEAR, ESPECIALLY SPORTS FOOTWEAR

[75] Inventor: Francis Denu, La Walk, France

[73] Assignee: Adidas Fabrique de Chaussures de Sport, Landersheim, France

[21] Appl. No.: 819,677

[22] Filed: Jul. 28, 1977

[30] Foreign Application Priority Data

Jul. 29, 1976 [FR] France ..... 76 23173

[51] Int. Cl.[2] ..... A43B 13/12; A43C 15/00

[52] U.S. Cl. ..... 36/30 R; 36/32 R; 36/59 C

[58] Field of Search ..... 36/32 R, 28, 30 R, 59 C

[56] References Cited

U.S. PATENT DOCUMENTS

| | | | |
|---|---|---|---|
| 1,584,626 | 5/1926 | MacPherson | 36/30 R X |
| 1,955,720 | 4/1934 | Rollmann | 36/32 R X |

FOREIGN PATENT DOCUMENTS

| | | | |
|---|---|---|---|
| 1546521 | 10/1968 | France | 36/32 R |
| 463389 | 4/1951 | Italy | 36/32 R |
| 280453 | 1/1952 | Switzerland | 36/59 C |
| 598513 | 2/1948 | United Kingdom | 36/59 C |

*Primary Examiner*—James Kee Chi

*Attorney, Agent, or Firm*—Brisebois & Kruger

[57] ABSTRACT

A sole for footwear, especially sports footwear, has a lower layer provided with transverse ribs and an upper shock-absorbing layer. The lower layer may be of natural rubber of Shore hardness from 55 to 60 and the upper layer of lower-density natural or synthetic rubber of Shore hardness about 40.

8 Claims, 4 Drawing Figures

SOLE FOR FOOTWEAR, ESPECIALLY SPORTS FOOTWEAR

BACKGROUND OF INVENTION

The present invention relates to soles for footwear which are especially useful for shoes for sports and exercise, for example cross-country running, training for various athletic events, competitive walking and long distance track running.

SUMMARY OF INVENTION

According to one aspect of the invention there is provided a sole for footwear comprising a lower abrasion-resistant layer, of a shape generally following the outline of the foot, comprising a plurality of downwardly-projecting ribs to touch the ground, the ribs being substantially perpendicular to the longitudinal axis of the foot, and an upper layer capable of impact attached to the lower layer.

Another aspect of the invention relates to footwear provided with such a sole.

The abrasion-resistant layer is preferably made of high-quality natural rubber having a Shore hardness from 55 to 60. The upper impact-absorbing layer, or "damping layer" should be of a material capable of at least partially absorbing shocks transmitted from the ground to the foot; it may be of expanded synthetic rubber or a natural rubber of very low density having a Shore hardness of about 40.

The sole may have ribs arranged perpendicularly to the axis of the foot over practically all its lower surface. The ribs may be separated by gaps of which the depth and width are substantially equal to the width of the ribs, allowing provision of a shoe having excellent comfort and very good adhesion to the ground.

The sole according to the invention has a very great flexibility about axes perpendicular to the longitudinal axis of the foot (i.e., to the normal direction of travel of the wearer) which renders walking and running especially comfortable. On the other hand the sole has a high rigidity with respect to rotations about other axes, in particular axes parallel to the longitudinal axis of the foot, which ensures an excellent retention of the foot in the shoe.

The structure of the layer resistant to abrasion can ensure rigidity of the sole in the transverse direction and flexibility in the longitudinal direction, the impact-absorbing layer being easily deformed.

The sole is highly flexible in the longitidunal direction but may also have a high elasticity which at each step communicates to the foot an impulse forward which facilitates walking and running.

In a preferred embodiment the ribs which project on the lower part of the sole are interrupted at zones situated alternately on the right and on the left parts of the sole in such a manner as to increase the resistance to lateral sliding of the sole, especially on loose terrain and on snow without appreciably reducing the transverse rigidity of the sole which is required for good retention on the foot.

In one embodiment the forward and rearward ends of the sole are rounded and comprise grooves of several millimeters amplitude which are parallel to the ribs of the sole. It is also advantageous to make the lower surface of the ribs in such a manner that they comprise reliefs which resist sliding of the shoe.

In a method of making the sole, first of all the layer resistant to abrasion is vulcanised and then there is injected or vulcanised onto this layer, the damping layer which is made of synthetic or natural rubber.

The sole formed by the combination of a lower layer resistant to abrasion and the damping layer may be easily adhered to the lower part of a shoe.

DESCRIPTION OF SPECIFIC EMBODIMENT

Figure 1:
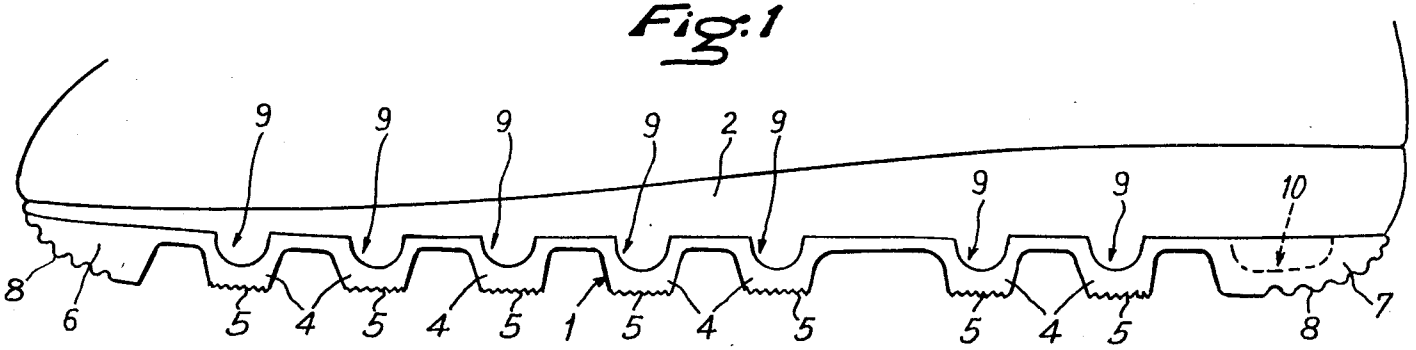
Figure 2:
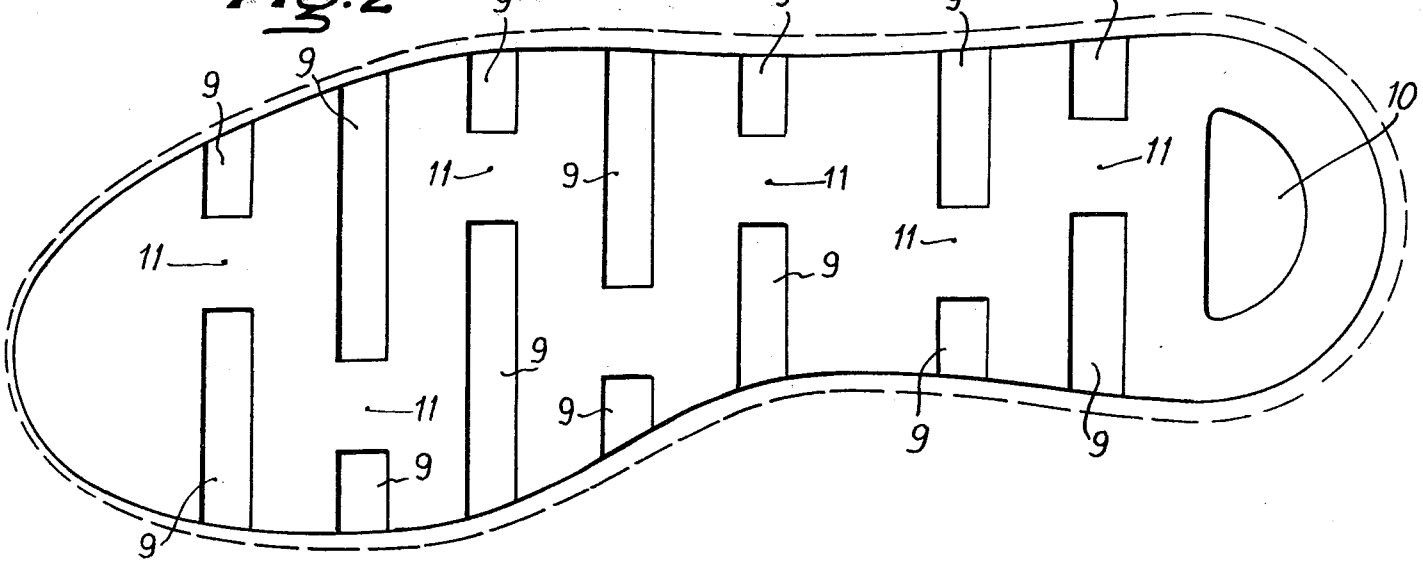
Figure 3:
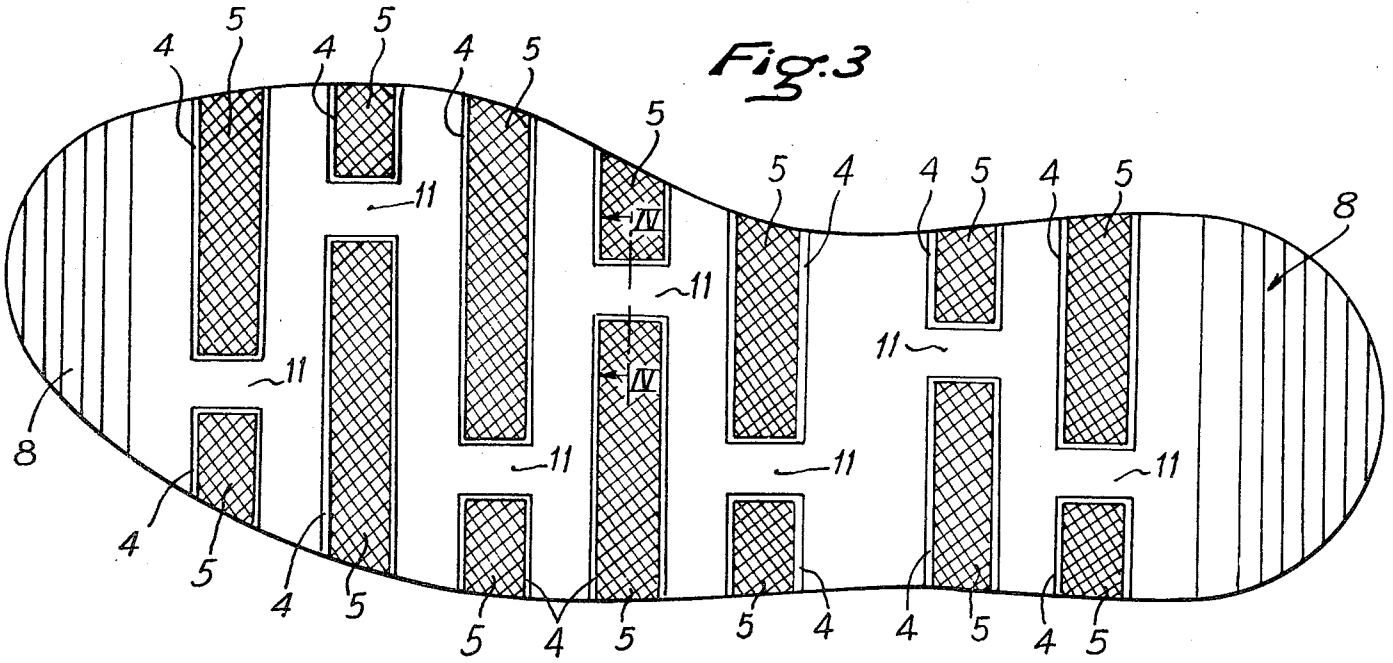
Figure 4:
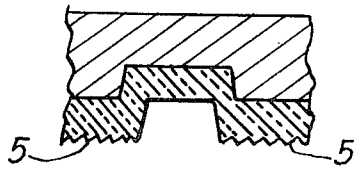

An embodiment of the invention will be described by way of example with reference to the accompanying drawings in which:

FIG. 1 is a lateral view of the lower part of a running shoe comprising a sole according to an embodiment of the invention, FIG. 2 is a view from above of a layer resistant to abrasion forming part of the sole of FIG. 1, FIG. 3 is a view from below of the sole of FIG. 1, FIG. 4 is a view in section on line IV—IV of FIG. 3.

There is shown in FIG. 1 the layer resistant to abrasion 1 on which there is fixed the damping layer 2 which is itself adhered to the lower part of the shoe 3.

As shown in FIG. 3 the bottom of the sole has over most of its surface ribs 4 which are arranged transversely with respect to the longitudinal axis of the shoe.

In the embodiment described the ribs are seven in number, five of them being at the front part of the foot and two at the rear.

The lower surfaces 4 of the ribs have a relief profile 5 for example of the type comprising small "diamond" points. The forward end 6 and the heel 7 of the sole are provided with undulations 8 forming grooves parallel to the ribs 4.

As seen in FIg. 1 apart from the forward and rear ends of the sole the layer which is resistant to abrasion 1 has a relatively small thickness which is substantially uniform and of the order of aproximately 2 to 6 mm, the upper part of the layer 1 having openings or grooves of substantially half-cylindrical shape as shown at 9 in the drawing.

It will be noted that the grooves 9 open on both sides of the shoe in order to facilitate flexing of the layer resistant to abrasion in the longitudinal direction.

The heel 7 of the layer 1 is cut away at 10 to make the sole lighter.

As is seen in FIG. 1 the damping layer 2 has a greater thickness on the rear part of the shoe in order to increase the height of the heel, the lower part of the sole being substantially flat, ignoring the spaces between the ribs 4.

According to a preferred embodiment of the invention the layer resistant to abrasion is formed of natural rubber of very high quality having a Shore hardness from about 55 to 60 whereas the damping layer is formed either of expanded synthetic rubber known under the name "TR" having a Shore hardness of about 40, or a natural rubber of very low density also having a Shore hardness of about 40.

In FIg. 2 which is a view from above of the layer resistant to abrasion there are seen in the openings 9 which open onto the right and left parts of the sole and also zones 11 where these openings are interrupted, the zones 11 being located in this embodiment alternately towards the right and left side of the sole, so as to increase the resistance to lateral sliding of the sole.

In FIG. 2 there is also shown in interrupted lines a contour of the shoe itself.

As is shown in FIG. 3 the bottom of the sole has ribs 4 which are interrupted in the zones 11 as previously indicated and of which the lower surfaces 5 are roughened.

There is shown in FIG. 4 in section along IV—IV of FIG. 3 the profile of the layer resistant to abrasion at the level of the zones of interruption of the ribs.

I claim:

1. A sole for footwear comprising a lower layer of abrasion-resistant material having a lower surface comprising a plurality of downwardly-projecting ribs to touch the ground, the ribs being substantially perpendicular to the longitudinal axis of the footwear, and an upper layer of impact-absorbing material attached to the lower layer, and in which the upper surface of the lower layer is provided with grooves corresponding to the ribs, the grooves extending to the sides of the sole and being occupied by corresponding downwardly-projecting portions of the upper layer.

2. A sole according to claim 1, in which the abrasion-resistant material is natural rubber having a Shore hardness from 55 to 60.

3. A sole according to claim 1, in which the lower layer has a substantially uniform thickness from 2 to 6 mm.

4. A sole according to claim 1, in which the ribs run from one side of the sole to the other and are interrupted by gaps at locations displaced from the centre of the rib towards alternate sides of the sole for successive ribs.

5. A sole according to claim 1, in which the upper layer is composed of expanded synthetic rubber having a Shore hardness of about 40.

6. A sole according to claim 1, in which the upper layer is composed of natural rubber of low density having a Shore hardness of about 40.

7. A sole according to claim 1, in which the front and rear end of the lower layer comprise downward projections having a lower surface substantially flush with the lower surfaces of the ribs, the projections being rounded at the ends of the sole.

8. Footwear provided with a sole according to claim 1.

* * * * *